US006261120B1

(12) United States Patent
Beege et al.

(10) Patent No.: US 6,261,120 B1
(45) Date of Patent: Jul. 17, 2001

(54) RESILIENT CONTACT FOR CONNECTING ELECTRICAL CONDUCTORS

(75) Inventors: Werner Beege, Hainburg; Werner Radde, Babenhausen; Manfred Domrath, Weener; Reinhard Ruhm, Pfungstadt; Klaus Steinmetz, Flörsheim; Hubert Herrmann, Eppertshausen, all of (DE)

(73) Assignee: Weidmüller Interface GmbH & Co, Detmold (DE)

( * ) Notice: Subject to any disclaimer, the term of this patent is extended or adjusted under 35 U.S.C. 154(b) by 0 days.

(21) Appl. No.: 09/644,841

(22) Filed: Aug. 24, 2000

(30) Foreign Application Priority Data

Sep. 3, 1999 (DE) ..... 299 15 515 U

(51) Int. Cl.[7] ..... H01R 11/20
(52) U.S. Cl. ..... 439/441; 439/268
(58) Field of Search ..... 439/441, 835, 439/268, 834, 775, 786, 803

(56) References Cited

U.S. PATENT DOCUMENTS 5,685,735 * 11/1997 Hohorst ..... 439/441
5,915,991 * 6/1999 Roman ..... 439/441
5,993,270 * 11/1999 Geske et al. ..... 439/835
6,146,187 * 11/2000 Pallai ..... 439/441
6,146,217 * 11/2000 Osada ..... 439/835

FOREIGN PATENT DOCUMENTS 1975278 7/1967 (DE) .
1261923 2/1968 (DE) .
7719374 9/1977 (DE) .
2062158 4/1979 (DE) .
209321 4/1984 (DE) .
4233446 10/1993 (DE) .
9420097 2/1996 (DE) .
908965 4/1999 (EP) .

* cited by examiner

*Primary Examiner*—Tulsidas Patel
*Assistant Examiner*—Son V. Nguyen
(74) *Attorney, Agent, or Firm*—Laubscher & Laubscher

(57) ABSTRACT

A resilient electrical contact of generally V-shaped configuration includes a support leg mounted generally parallel with and spaced from a bus bar, and a clamping leg for biasing an electrical conductor toward lateral electrical engagement with the bus bar, characterized in that the contact clamping leg includes a stepped portion that terminates in an offset terminal portion that biases the conductor in lateral engagement with the bus bar, which terminal portion carries a clamping edge that resists withdrawal of the conductor from the contact. In order to disconnect the conductor from the contact, the device is provided for displacing the clamping leg from the bus bar, thereby to permit withdrawal of the conductor from the contact.

9 Claims, 3 Drawing Sheets

RESILIENT CONTACT FOR CONNECTING ELECTRICAL CONDUCTORS

FIELD OF THE INVENTION

This invention relates to a resilient contact for connecting a conductor with a bus bar, including a clamping leg that biases the conductor toward the bus bar, said clamping leg having a clamping edge that engages the conductor to resist the withdrawal thereof from the contact, and means for displacing the clamping leg to a released position spaced from the bus bar, thereby to permit insertion and withdrawal of the conductor, respectively, relative to the resilient contact.

BACKGROUND OF THE INVENTION

Brief Description of the Prior Art

Resilient contacts for connecting a conductor to a bus bar are well known in the patented prior art, as evidenced by the U.S. patents to Beege, et al., U.S. Pat. No. 5,938,484 and Delarue, et al., U.S. Pat. No. 5,879,204, among others.

As evidenced by the German Auslegeschrift No. 1,261, 923, the German patent No. 4233446 and the European patent No. 908,965, the clamping edge at the free end of the clamping leg of the resilient contact normally continues to be pointed toward the electrical conductor as the clamping leg is displaced toward the released position, whereupon as the conductor is withdrawn from the contact, there is a possibility of damaging the conductor, which may be particularly undesirable in the case of a multi-wire conductor, or a fine-wire conductor. This applies also to the resilient contact of the German patent No. 2062158 B2, wherein the free end of the clamping leg of the resilient contact is bent only at a small angle.

As shown by the German Auslegeschrift No. 1,261,923 and the European patent No. 908,8965, it has been proposed to provide adjacent the clamping leg of a resilient contact an operating member that functions to displace the clamping leg toward a disengaged position relative to the conductor. These devises have generally proven to be undesirable, however, owing to the fact that the actuation surface on the clamping leg lies ahead of the clamping edge. When the actuating devices are in the form of levers or rams, as shown by the German patent Nos. DE 2062158 B2 and DE 4233446 C1, for example, the points of engagement are at undesirable locations on the clamping leg ahead of the clamping edge.

The present invention was developed to avoid the above and other drawbacks of the known resilient connectors.

SUMMARY OF THE INVENTION

Accordingly, a primary object of the present invention is to provide an improved resilient contact including a clamping leg that is reliably operable to a released position without the possibility of damage to the conductor during the insertion and withdrawal thereof, respectively, relative to the contact.

According to a more specific object of the invention, the clamping leg of the resilient contact includes an offset terminal portion defined by a pair of successive right-angled bends, whereby when the clamping leg is displaced to its disengaged position relative to the conductor, the terminal portion of the clamping leg carrying the clamping edge is no longer directed toward the conductor, but rather is arranged in a disengaged position generally parallel with the conductor. As a consequence of this design, the conductor can be inserted into and withdrawn from the resilient contact without damage even in the case of multi-wire and fine-wire conductors.

According to another object of the invention, the clamping leg is provided with an actuation tab having an actuation surface that extends at least the length of the terminal portion; i.e., at least to the clamping edge. This design ensures that the clamping leg may be displaced toward its released position relative to the conductor with the least amount of friction with the clamping leg being produced by the actuating member.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
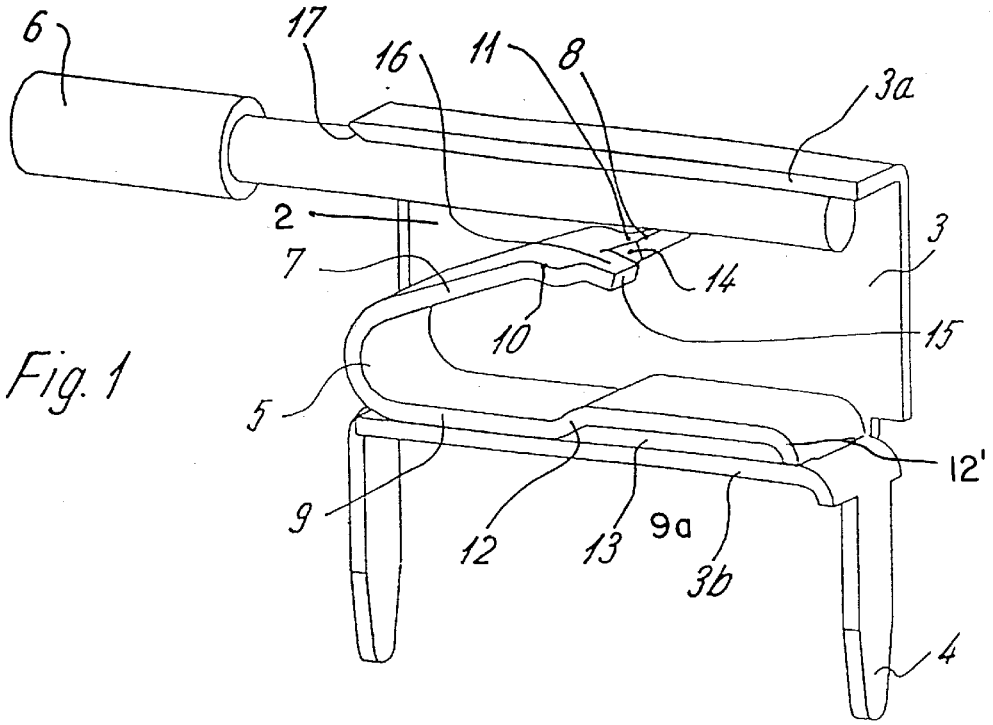
FIG. 1 is a front perspective view of the resilient contact and bus bar arrangement of the present invention.

Referring first more particularly to FIG. 1, the resilient contact 5 is formed of electrically conductive metal and includes a support leg 9, and an angularly arranged clamping leg 7. The resilient contact 5 is mounted within a chamber 2 that is defined between the parallel spaced upper and lower flange portions 3*a* and 3*b* of a generally U-shaped bus bar 3. The contact support leg 9 is supported by the lower bus bar flange portion 3*b*, and the clamping leg 7 serves to clamp an electrical conductor 6 laterally against the upper flange portion 3*a* of the bus bar 3. The bus bar 3 includes a pair of leg portions 4 that extend downwardly from the opposite ends of the bus bar flange portion 3*b*, thereby affording means for connecting the bus bar to a main circuit bus bar (not shown).

Figure 1A:
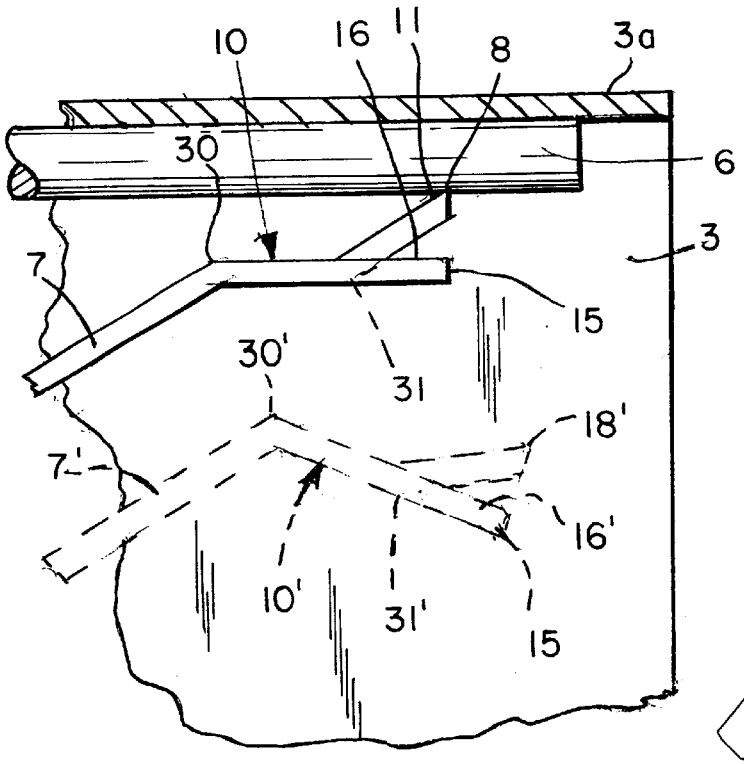
FIG. 1A is a detailed view of the free end portion of the clamping leg of the contact of FIG. 1.

In accordance with a characterizing feature of the invention, the free end portion of the clamping leg 7 includes a stepped portion 10 that is bent at a first obtuse angle by the first bend 30 in the direction of the support leg 9. The stepped portion 10 contains a longitudinal slit 14 that defines an actuating tab portion 15 which is a linear extension of the stepped portion 10, and an offset terminal portion 11 that is angularly bent by the second bend 31 at an obtuse angle in the direction of the bus bar flange portion 3*a*. The offset terminal portion terminates in a clamping edge 8 that is arranged to engage the conductor 6. The introductory end of the upper flange portion 3*a* of the bus bar 3 is chamfered to define an angularly arranged insertion surface 17 for guiding the conductor 6 into the bus bar chamber 2. Thus, when the conductor 6 is in the fully inserted position shown in FIG. 1, the clamping leg 7 biases the conductor toward lateral conductive In accordance with another characterizing feature of the invention, in order to remove the clamped conductor 6 from the bus bar chamber 2, a downwardly directed force is applied to the upper actuating surface 16 of the actuating tab 15, thereby to displace the clamping leg 7 downwardly toward the support leg 9, and to release the clamping edge 8 from the under surface of the electrical conductor 6. The conductor 6 may then be axially displaced to the left to withdraw the same from the bus bar chamber 2. It is important to note that owing to the angular relationship between the terminal portion 11 of clamping leg 7 and the actuating tab 15, the terminal portion 11 is generally parallel with the upper bus bar flange 3*a* when the clamping leg is downwardly displaced to the released position, as shown in phantom FIG. 1A.

Figure 2:
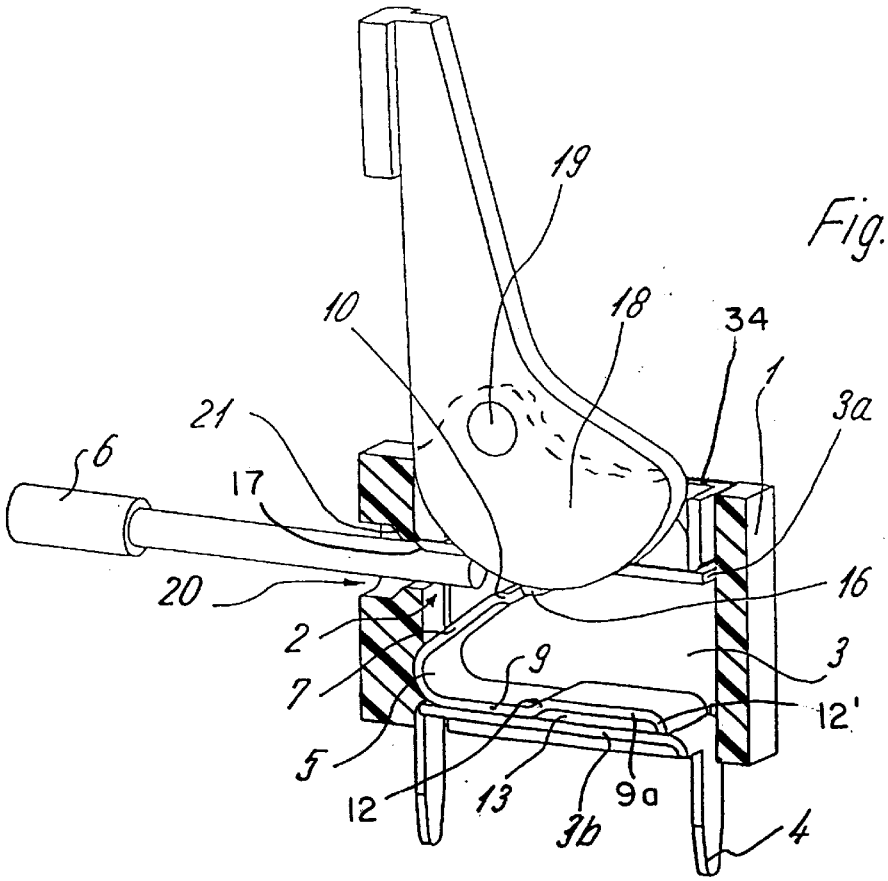
FIG. 2 is a front perspective view of a first embodiment of the invention including an eccentric operating lever in the inactive position prior to the insertion of a conductor.
Figure 3:
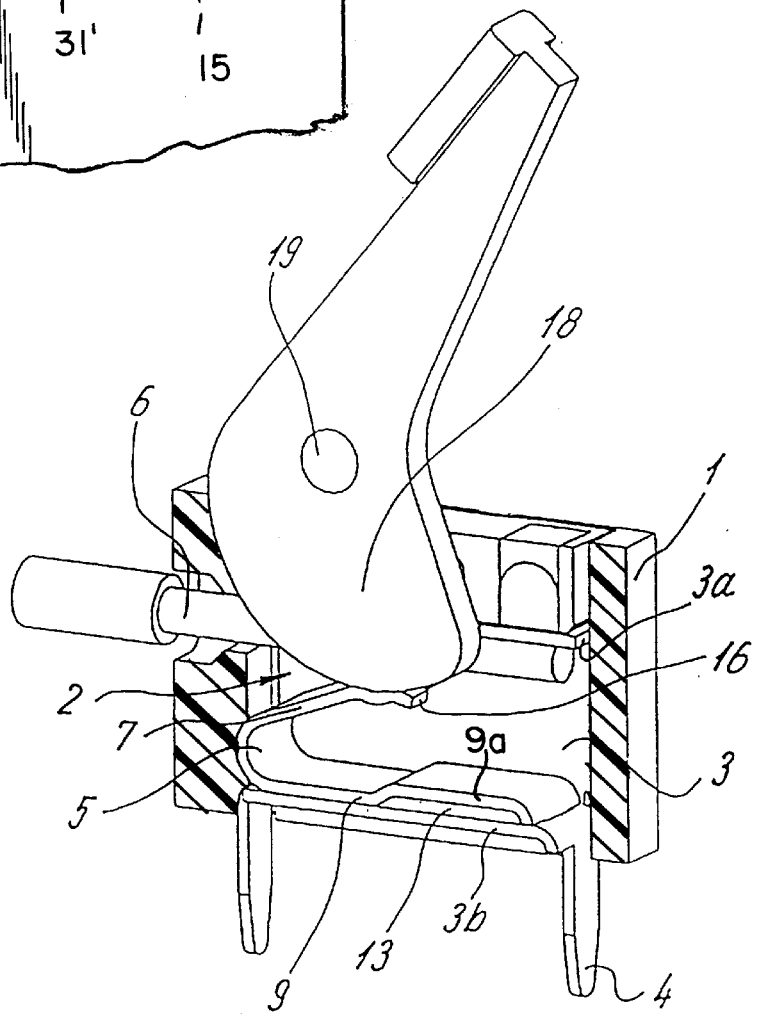
FIG. 3 is a corresponding view of the apparatus of FIG. 2 with the operating lever in the activated position and the conductor in the fully inserted position.

Referring now to FIGS. 2 and 3, the bus bar and resilient contact arrangement of FIG. 1 is mounted within a recess contained in the housing 1 that is formed of a conventional electrical insulating material. The electrical conductor 6 is introduced within the bus bar chamber 2 via an opening 20 contained in the associated side wall of the housing 1. To assist the insertion of the conductor 6 into the chamber 2, the wall portion of the opening 20 is chamfered to define the generally conical insertion surface 21. In accordance with another feature of the invention, an eccentric operating lever 18 is provided that pivotally connected with the pivot axis 19 that is carried by a mounting member 34 that is secured to the housing 1. The eccentric lever 18 has a cam surface adapted to engage the uppermost actuation surface 16 on the actuating tab 15, whereby when the lever 18 is pivoted in the clockwise direction from the inactive position of FIG. 2 toward the active position of FIG. 3, the clamping leg 7 is displaced downwardly toward the support leg 9 against the inherent biasing force of the resilient contact, whereby the clamping edge 8 is released from the conductor 6, thereby to permit removal of the conductor from, or insertion of the conductor 6 into, the bus bar chamber 2. It is important to note that only a small area of the actuating surface 16 is engaged by the cam surface of the eccentric lever 18, thereby to keep the friction forces between these elements as small as possible. Owing to the provision of the chamfered conical surface of the opening 20 and the chamfered surface 17 of the introductory end of the bus bar flange portion 3*a*, damage to multi-wire conductors or fine-wire conductors is greatly reduced.

Figure 4:
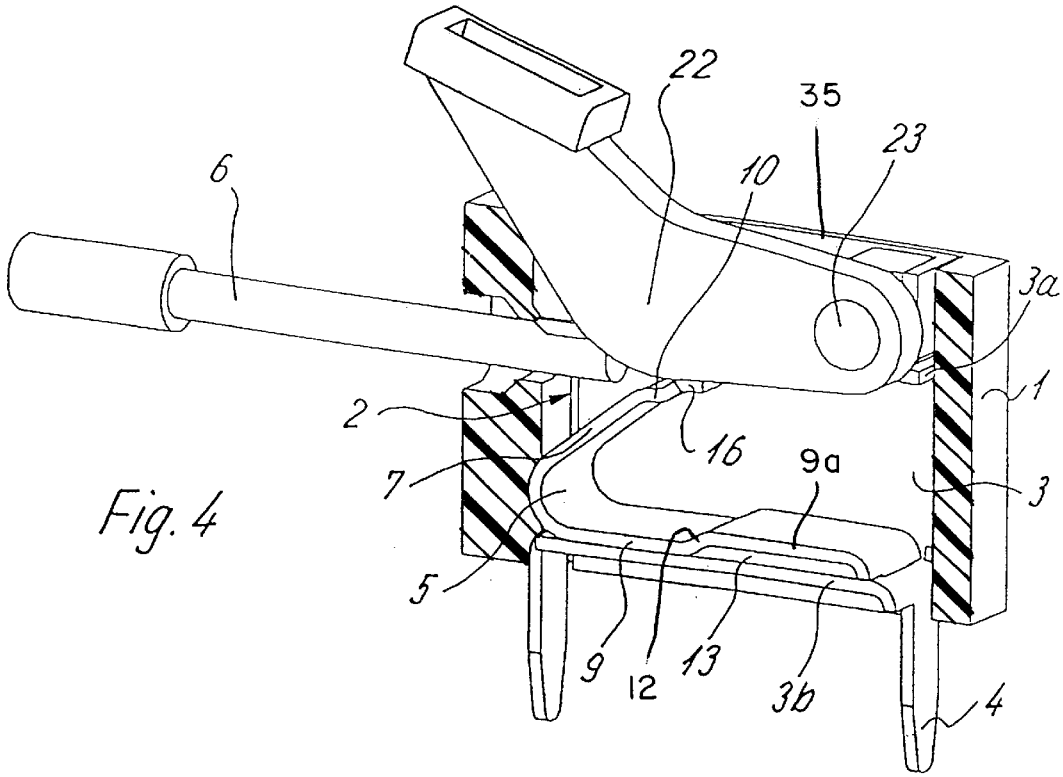
FIG. 4 is a front perspective view of a second embodiment of the invention including a pivotally connected operating lever.

Referring now to the embodiment of FIG. 4, the pivot lever 22 pivots about a pivot axis 23 that is carried by the mounting member 35 and is arranged, forwardly of, and generally transverse to a longitudinal extension of the axis of, the conductor 6. In this case, the operating lever 22 is operated in the counter-clockwise direction to engage the operating surface 16 on the clamping leg 7, whereby the clamping leg may be angularly displaced toward the support leg 9 to permit the insertion of the conductor 6 within the bus bar chamber 2. Upon release of the operating lever 22 in the clockwise direction, the clamping leg 7 expands relative to the support leg 9, thereby to cause the clamping edge 8 to engage the adjacent surface of the conductor 6, whereby removal of the conductor from the bus bar chamber 2 is prevented.

Figure 5:
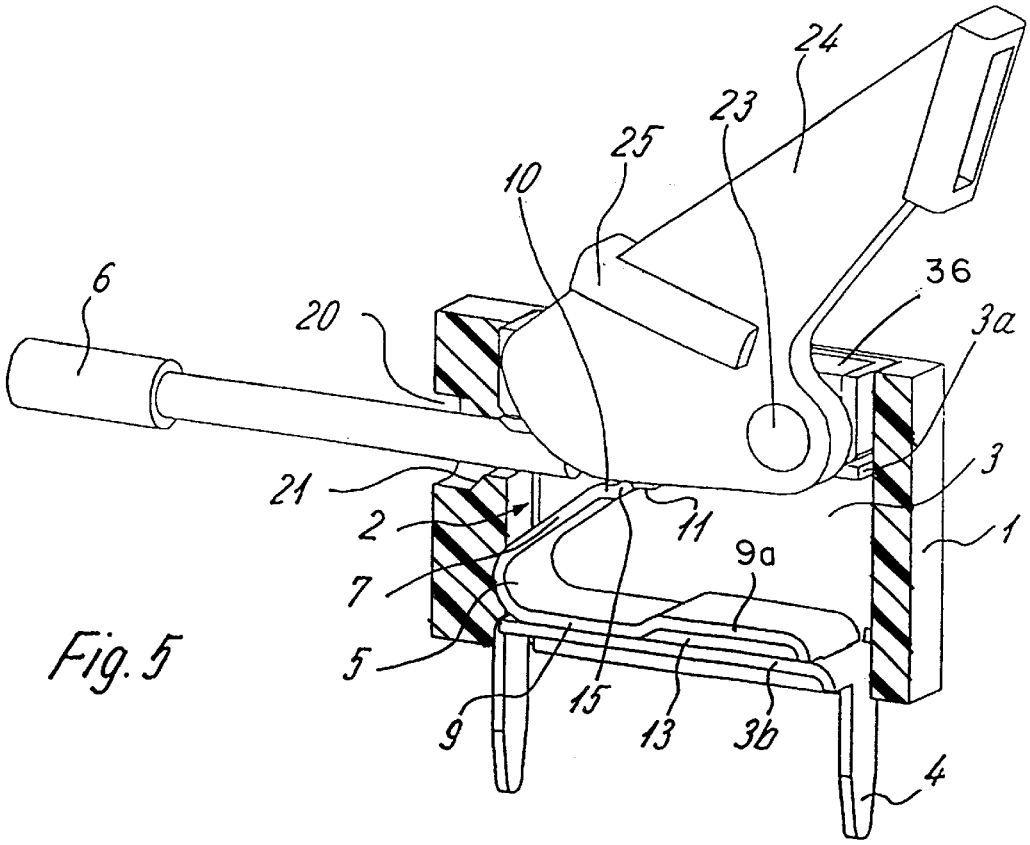
FIG. 5 is a third embodiment of the invention wherein the operating lever is provided with a protective stop.

In the modification of FIG. 5, a protective stop member 25 is provided on the pivot lever 24. This stop member is adapted to engage the mounting member 36 to limit the extent of displacement of the operating lever 24 in the counter-clockwise direction, thereby to prevent the clamping leg 9 from being overly compressed relative to the support leg 9, and thereby damage the operability of the resilient contact.

In accordance with another feature of the invention, in each of these embodiments, the support leg 9 is strengthened by the provision of a strengthening portion 9*a* defined by the double right angle bend 12 and the single right angle bend 12', thereby to define a clearance space 13 between the strengthening portion 9*a* and the lower flange portion 3*b* of the bus bar 3.

As shown in FIGS. 4 and 5, the location of the pivot axis 23 may be varied forwardly of the clamping leg 7 in order to produce the desired operating force on the clamping leg 7. In this way, one can produce design variants for resilient connectors in a cost-saving manner according to the various needs of the user.

It is apparent that during the manufacture of the resilient contact, the free end of the clamping leg is initially split by the slit 14, whereupon after the formation of the first bend 30, only the terminal portion 11 is bent upwardly by the second bend 31, the actuation tab portion 15 being an extension of the associated terminal portion defined by the first bend 30.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A resilient contact assembly, comprising:

(a) a housing (1) containing a chamber, said housing including an opening (20) communicating with said chamber, said housing opening having longitudinal axis;

(b) a bus bar (3) mounted in said housing chamber, said bus bar having a first flat portion (3*a*) parallel with and spaced from said housing opening axis;

(c) a resilient electrical contact (5) mounted in said housing chamber, said resilient contact including:

(1) a support leg (9) parallel with and spaced from said bus bar first flat portion on the opposite side thereof from said housing opening axis; and (2) a clamping leg (7) arranged at an acute angle relative to said support leg and extending in the direction of said bus bar flat portion, said clamping leg having a first end connected with said support leg, and a second end that terminates in a stepped portion (10) that is bent at a first obtuse angle in the direction of said support leg;

(3) said stepped portion containing a longitudinal slit (14) that defines in said stepped portion;

(a) an activating tab portion (15) having an activating surface (16) adjacent said bus bar flat portion; and (b) an offset terminal portion (11) that is angularly bent at a second obtuse angle in the direction of said bus bar flat portion, said terminal portion having a first end connected with said stepped portion, and a second end terminating in a clamping edge (8), said clamping leg normally being biased relative to said support leg toward an engaged position in which said clamping edge is arranged for engagement with the periphery of a conductor that is inserted within said chamber via said housing opening; and (d) displacing means (18) connected with said housing for engaging said activating tab portion to displace said clamping leg in the direction of said support leg toward a disengaged position in which said clamping edge is spaced from the longitudinal axis of said housing opening and from the conductor periphery, thereby to release the conductor for removal from said housing.

2. The resilient contact assembly as defined in claim 1, wherein said terminal portion (11) is generally parallel with said bus bar when said clamping leg is in said disengaged position.

3. The resilient contact assembly as defined in claim 1, wherein said support leg contains a strengthening recess (13) defined by a pair of successive oppositely directed transverse bends (12, 12').

4. The resilient contact assembly as defined in claim 1, wherein said bus bar (3) has a generally U-shaped cross-section and includes a planar base portion, and a pair of parallel flange portions **(3*a*,3*b*) arranged orthogonally relative to said base portion, said base and flange portions cooperating to define a bus bar chamber (2) that receives said contact member, said support leg being generally parallel with and supported by a first one of said flange portions (3*b*)**.

5. The resilient contact assembly as defined in claim 4, wherein the other of said bus bar flange portions **(3*a*) has at one end a chamfered insertion surface (17)** which guides the end of the conductor during the insertion thereof into said bus bar chamber.

6. The resilient contact assembly as defined in claim 1, wherein said displacing means includes a cam lever (18) that is pivotally connected with said housing for pivotal movement about a pivot axis (19).

7. The resilient contact assembly as defined in claim 1, wherein said displacing means includes a pivot lever (22; 24) that is pivotally connected with said housing for pivotal movement about a pivot axis (23) that is contained in a plane arranged generally axially of said clamping leg portion when said clamping leg portion is in said disengaged position.

8. The resilient contact assembly as defined in claim 7, wherein said pivot lever includes an operating portion that cooperates with said actuating portion when said pivot lever is operated in a given direction of rotation.

9. The resilient contact assembly as defined in claim 8, and further including protective stop means (25) for limiting the pivotal movement of said pivot lever in said one direction, thereby to protect said contact member clamping leg against overload.

* * * * *